United States Patent [19]

Mathews et al.

[11] Patent Number: 4,622,983

[45] Date of Patent: Nov. 18, 1986

[54] REDUCED IGNITION PROCLIVITY SMOKING ARTICLE WRAPPER AND SMOKING ARTICLE

[75] Inventors: John H. Mathews; Donald F. Durocher; Vladimir Hampl, Jr., all of Roswell, Ga.

[73] Assignee: Kimberly-Clark Corporation, Neenah, Wis.

[21] Appl. No.: 627,710

[22] Filed: Jul. 11, 1984

Related U.S. Application Data

[63] Continuation-in-part of Ser. No. 521,487, Aug. 8, 1983, abandoned.

[51] Int. Cl.[4] ..... A24D 1/02

[52] U.S. Cl. ..... 131/365; 131/331; 131/358; 131/364

[58] Field of Search ..... 131/358, 365, 331, 364

[56] References Cited

U.S. PATENT DOCUMENTS

| | | |
|---|---|---|
| 2,998,012 | 8/1961 | Lamm . |
| 3,667,479 | 6/1972 | Sanford . |
| 4,044,778 | 8/1977 | Cohn . |
| 4,230,131 | 8/1980 | Simon . |
| 4,231,377 | 11/1984 | Cline . |
| 4,452,259 | 6/1984 | Norman . |
| 4,461,311 | 7/1984 | Mathews . |

FOREIGN PATENT DOCUMENTS 85494 8/1983 United Kingdom .

*Primary Examiner*—V. Millin

*Attorney, Agent, or Firm*—William D. Herrick

[57] ABSTRACT

The invention is an improved wrapper construction for smoking articles such as cigarettes resulting in a reduced tendency to ignite combustible materials accidentally or carelessly coming into contact with the lit cigarette. The wrapper constructions and smoking articles of the invention have a specially designed structure which causes a cigarette to go out quickly when in contact with a substrate, including many commonly-encountered substrates made of combustible materials. This structure is characterized by a Burn Mode Index ("BMI") as defined for the wrapper of between about 1.5 $cm^{-1}$ and 5.0 $cm^{-1}$ for a single wrap embodiment. For an alternative double wrapped embodiment, the outer wrap will have a BMI in the range of from about 2.0 $cm^{-1}$ to about 40 $cm^{-1}$ depending on the BMI of the inner wrap which may vary between about 0.1 $cm^{-1}$ to 4.0 $cm^{-1}$. The preferred amount of burn promoter is at least 15 mg anhydrous potassium citrate per gram of bone dry paper or stoichiometrically equivalent amounts of other burn promoting salts.

Preferred substrate embodiments include paper made from flax or other cellulosic fibers, treated with elevated amounts of an alkali metal burn promoter such as alkali metal salts of carboxylic acids, especially potassium salts. In contrast to other attempts, these results are obtained without a significant sacrifice of desired taste and smoke deliveries, for example, without unacceptable increases in puff count or significant increases in delivered tar and carbon monoxide. Wrapper constructions and smoking articles of this invention may be manufactured using conventional cigarette paper processes and equipment.

18 Claims, 5 Drawing Figures

Single wrapped cigarettes

Single wrapped cigarettes

Double wrapped cigarettes

REDUCED IGNITION PROCLIVITY SMOKING ARTICLE WRAPPER AND SMOKING ARTICLE

CROSS-REFERENCE TO RELATED APPLICATION

This application is a continuation-in-part of our copending application Ser. No. 521,487, filed Aug. 8, 1983, now abandoned.

BACKGROUND OF THE INVENTION

1. Field of the Invention

The present invention relates to smoking articles such as cigarettes and to wrappers for such smoking articles which reduce ignition proclivity, i.e., the tendency to cause ignition of surfaces which come in contact with the lit cigarette. Reports have been made of fires attributed to burning cigarettes coming in contact with combustible materials. Such reports have generated interest in reducing the tendency of cigarettes to ignite surfaces and materials forming furniture, bedding, and the like upon contact. One obviously desirable attribute of cigarettes in this regard would be that they extinguish themselves if accidentally or carelessly dropped upon such combustible materials or surfaces. Since it is recognized by those skilled in the art that the wrapper strongly influences the behavior of a cigarette during smolder, modification of the wrapper construction to achieve these desired results would be highly beneficial. In particular, such a wrapper construction that does so without serious detrimental effects on desired smoking properties and characteristics would be especially advantageous. The present invention is directed to such wrapper constructions and improved smoking articles.

2. Description of the Prior Art

The subject of reducing the tendency of cigarettes to ignite upholstery, bedding, and the like has received much attention. Considerable effort has been directed to modification of cigarette papers to reduce to reduce fire hazards, including the development of non-burning wrappers for example as disclosed in U.S. Pat. No. 2,998,012 to Lamm dated Aug. 29, 1961, and design of wrappers having patterned rings or areas of non-burning materials for example as disclosed in U.S. Pat. No. 4,044,778 to Cohn dated Aug. 30, 1977.

It is also known, as in U.S. Pat. No. 4,321,377 to Cline, for example, to treat conventional wrappers with chemical adjuvants such as alkali metal citrates to control burn properties.

It is, moreover, known as described in copending and coassigned U.S. patent application Ser. No. 334,120 filed Dec. 24, 1981, now U.S. Pat. No. 4,461,311 dated July 24, 1984 to Mathews, DeLucia, and Mattina that the addition of extraordinary amounts of burn promotion additives to cigarette paper leads to a reduced emission of sidestream smoke. Cigarettes made with such papers normally would not have reduced ignition proclivity, however.

Additionally, copending and coassigned U.S. patent application Ser. No. 521,306 filed Aug. 8, 1983 refiled as Ser. No. 627,711 on July 11, 1984, describes wrappers for self-extinguishing cigarettes where the wrappers are treated in zones with elevated levels of burn promotion additives. Cigarettes made with these wrappers will not provide continuous free burn since they burn normally for a designed period of time and then reliably self-extinguish in air.

In summary, in spite of this extensive activity, it remains desired to produce a wrapper for cigarettes and the like that would result in the cigarette self-extinguishing when in contact with a substrate, including many composed of combustible materials, but which would otherwise perform as a conventional cigarette in terms of smoke delivery, puff count, free burn rate, and the like.

SUMMARY OF THE INVENTION

The present invention is directed to commercially practical wrapper constructions for smoking articles such as cigarettes, that reduce the ignition proclivity of cigarettes without substantial impairment of desirable cigarette properties, and to the resulting smoking articles. The wrappers of the present invention enable smoking articles to burn continuously at a desirable rate in air and yet self-extinguish quickly when dropped onto a substrate, including many common, combustible materials. Further, the smoking articles with wrappers of the present invention result in such benefits without a significant elevation in smoke delivery, thus satisfying the desires of smokers for lower tar delivery. In accordance with the invention, the wrappers and smoking articles may be white, opaque, and attractive in appearance, machine well on high speed cigarette making machines, require no new or unproven ingredients, and do not necessitate costly alterations in the manufacturing process or the composition of the wrapper construction.

In accordance with the invention, the wrappers have a structure defined by a Burn Mode Index ("BMI"), which is defined below and is a direct measure of the wrapper's ability to reduce the proclivity of cigarettes to ignite substrates. Additionally, the wrappers contain a finite amount of a burn promotion additive in order to allow smoking articles with that wrapper to free burn continuously in air. The required level of a burn promotion additive depends on the BMI of the wrapper.

In the single-wrap configuration the BMI of the wrapper can be between 1.5 $cm^{-1}$ and 5.0 $cm^{-1}$. In an alternative embodiment, a double-wrap configuration is employed, where the inner-wrapper is a paper with a BMI in the range of about 0.1 $cm^{-1}$ to 4.0 $cm^{-1}$ and the outer-wrapper can be a conventional cigarette paper. In either the single wrap or the double wrap configuration cigarettes will burn rapidly and to completion when suspended in air, for example, in an ash tray or during smoking. However, such cigarettes are very sensitive to environmental conditions, and, if dropped or otherwise put in contact with a surface, including those of many combustible materials, they will self-extinguish or, if they burn to completion, will result in minimal charring of the surface of the substrate material.

In summary, the unique and surprising feature of this invention for reduction of fire hazard is the use of burn promoters in specially designed papers whose structures are defined by the BMI. The result is a reduced fire hazard in contrast to conventional wisdom which would indicate that the use of burn promoters is antithetical to the goal of decreasing the fire hazard of cigarettes.

DESCRIPTION OF THE PREFERRED EMBODIMENTS

In the description which follows, certain tests have been employed which will be described.

Figure 1:
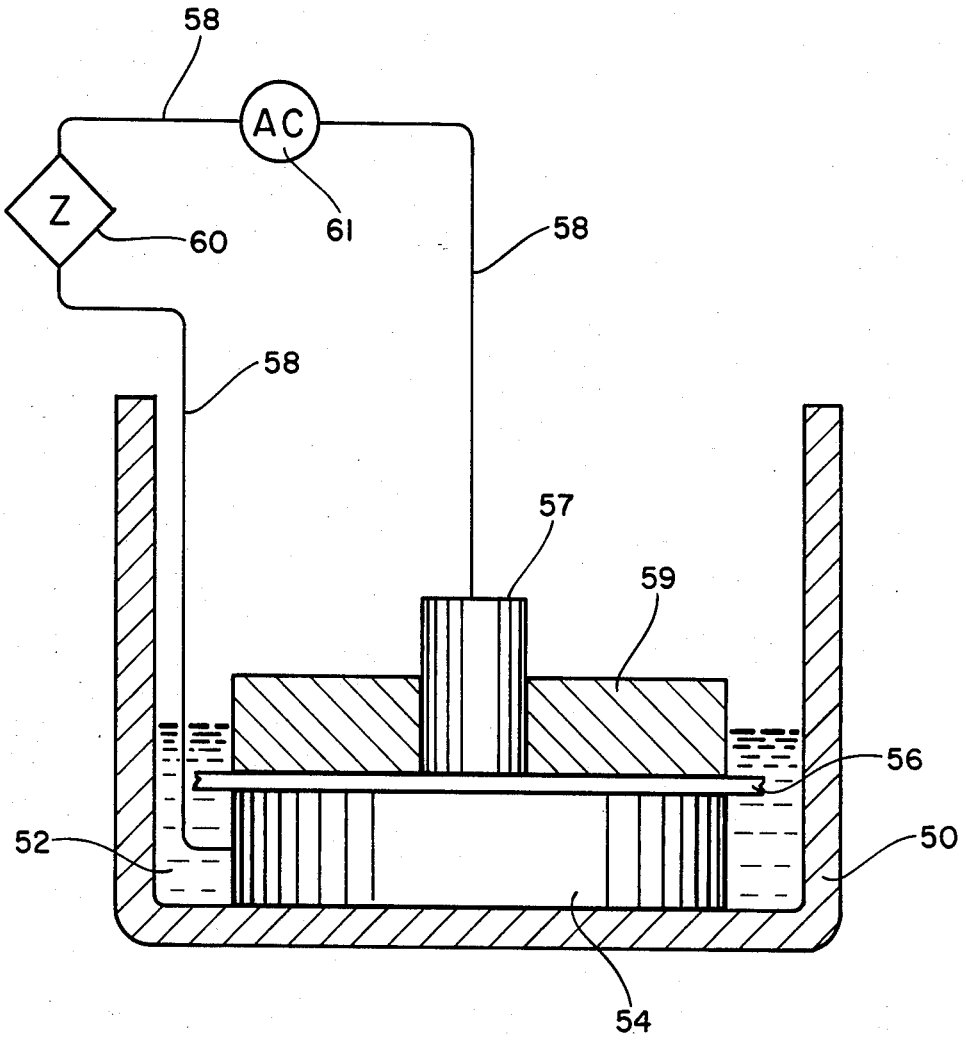
FIG. 1 depicts the apparatus for the determination of the Burn Mode Index.

The BMI test is based on the discovery that the wrapper's resistance to the flow of an electric current, when the paper is immersed in a non-aqueous solution of electrolyte and is placed between two electrodes, correlates very well with the fire ignition proclivity of a cigarette made with that wrapper. The ratio of the intrinsic resistivity of the electrolyte solution (ohm-cm) to the product of the electrical resistance of the paper (ohm) and the area of paper in mutual contact with both electrodes ($cm^2$) is defined as the "Burn Mode Index" (BMI), a direct measure of a wrapper's ability to suppress ignition proclivity. This electrical resistance was measured as a series resistance with an impedance bridge, Model 1658 manufactured by GenRad Corporation. An alternating voltage at a 1 kiloherz frequency was applied across the electrodes. The test cell is shown in FIG. 1. As illustrated, glass vessel 50 contains electrolyte 52, for example, an 0.5 molar solution of tetraethylammonium chloride in butyrolactone. Bottom electrode 54, having a diameter of about 7.6 cm, for example, supports paper sample 56 upon which is placed a top electrode 57 having a diameter of about 1.4 cm, for example, and surrounded by a nonconductive support 59 of, for example, Teflon (polytetrafluoroethylene). The electrodes are connected by wire 58 through impedance bridge 60 providing an alternating current of 1 Khz frequency. The electrodes may be, for example, gold-plated brass cylinders. The BMI is determined by dividing the intrinsic resistivity of the solution by the product of the measured resistance and the area of paper in contact with both electrodes (in the case described, area=1.6 $cm^2$).

The ignition proclivity results were obtained by lighting a cigarette, allowing it to smolder in air until the coal was fully developed, and then placing it on top of the crease made by two cushions at right angles to each other. The cushions were designed to simulate the seat and backing of furniture such as sofas and chairs. This test is similar to that used by UFAC. Each cushion was made by wrapping a piece of standard, Class II cotton flannel (UFAC) having a basis weight of 13.5 $oz/yd^2$, over a cushion of unfilled polyurethane foam (without fire retardant treatment), with a density of 1 $lb/ft^3$, 2 inches thick, 5 inches in width and 8 inches in length. The time for each cigarette to self-extinguish was noted. When the cigarette continued to burn over its entire length, the extinction time was recorded as infinite. In all such tests a standard cigarette 25 millimeters in circumference and 70 millimeters in length of tobacco column, made from a standard American tobacco blend was tested.

Oxygen concentration limits were determined by suspending lit cigarettes horizontally in a controlled draft chamber. Air admitted to the chamber was slowly diluted with nitrogen and the oxygen concentration at which each cigarette self-extinguished was recorded.

The cooling extinction test results were determined by attaching axially a length of No. 14 copper wire to a cigarette over a distance equal to about half the length of the cigarette. The free end of the wire was immersed in a heat sink and the cigarette was suspended horizontally in air. The end of the cigarette opposite the wire was lit and the time for each cigarette to extinguish after the leading edge of the coal reached the end of the wire was recorded. Where the cigarette continued to burn over its entire length, the extinction time was recorded as infinite.

Puff count was determined in accordance with standard FTC cigarette testing procedures. Carbon monoxide test results were obtained by gas chromatographic analysis of the smoke gas phase sampled during puffs.

The manufacture of paper for wrapping cigarettes is, of course, well-established. Conventional practice employs traditional wet-laid paper manufacturing steps of fiber dispersion, dilution, deposition on a foraminous wire, water extraction, pressing, and drying. The fiber component for cigarette paper is preferably flax, but other cellulose fibers may be used instead of or in combination with flax. Conventional mineral fillers up to about 50% by weight can be used, e.g., precipitated calcium carbonate, ground limestone, calcined kaolinite, titania, diatomaceous earth, sodium silico-aluminate, amorphous silica, calcium silicate, and others for purposes of producing desired opacity. As will be recognized by those familiar with papermaking, minerals of different particle size distribution, shape, and specific gravity may require alteration of fiber types or treatment such as refining or beating in order to obtain desired paper properties.

In accordance with the invention, however, it is necessary that the wrapper material properties of the single-wrapper in that embodiment, and the inner-wrapper in the double-wrap embodiment, be controlled within carefully defined limits.

Figure 4:
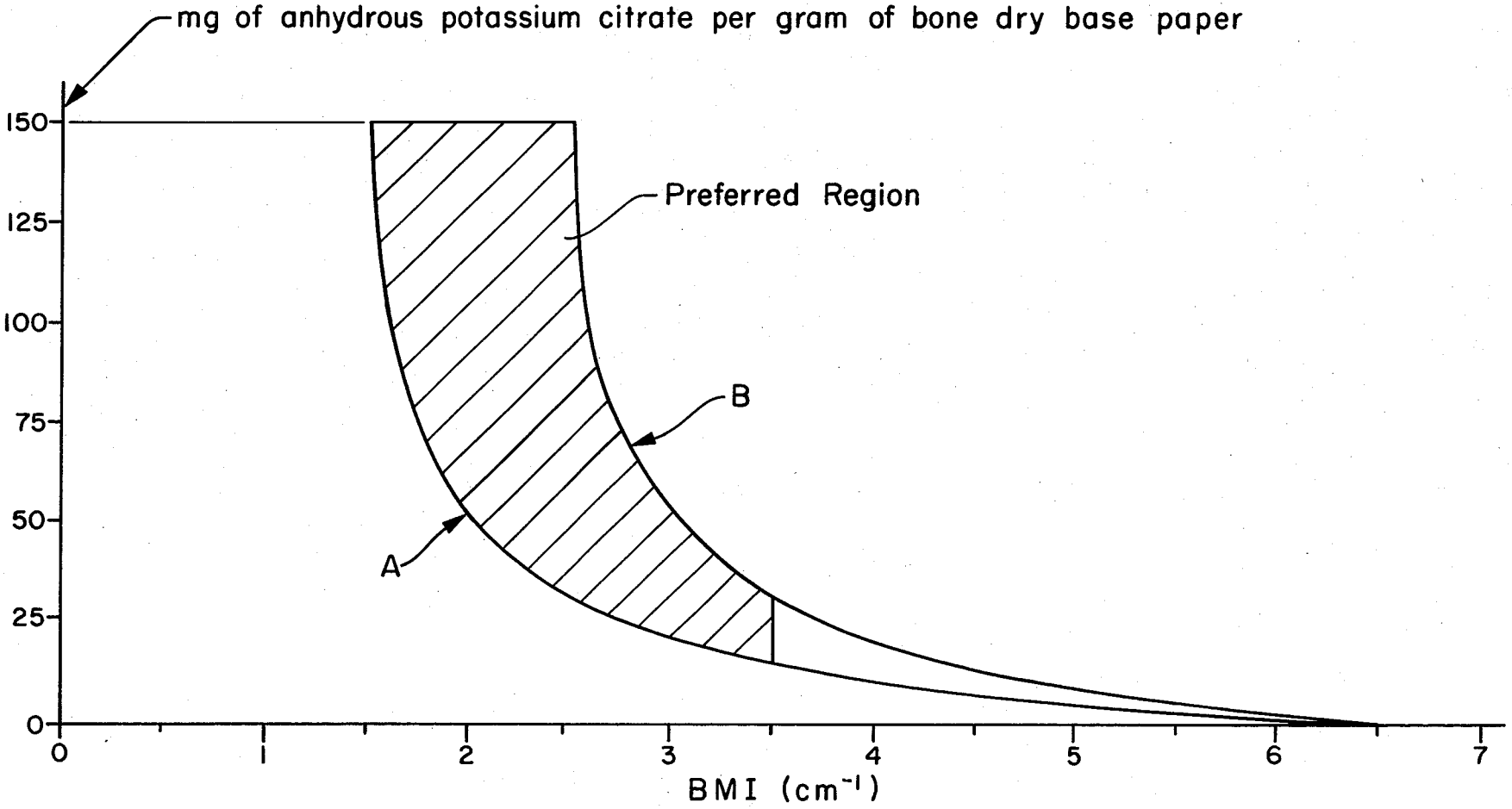
FIG. 4 illustrates in graph form the decreasing amounts of alkali- metal salt (as potassium citrate) required to obtain complete free burn in a single-wrap embodiment as a function of increases in the BMI as defined below. It also shows the range of paper structures and chemical levels for wrappers of cigarettes which will self-extinguish in the simulated upholstered furniture test, which is similar to the test used by the Upholstered Furniture Association Committee (UFAC). The preferred BMI range for wrappers in use with single-wrapped cigarettes is also shown.

The BMI of the wrapper for the single-wrap embodiment must be within the range of from about 1.5 $cm^{-1}$ to about 5.0 $cm^{-1}$, and preferably in the range of from about 1.5 $cm^{-1}$ to about 3.5 $cm^{-1}$. For comparison, BMI test values obtained on conventional wrappers are greater than 10 $cm^{-1}$ and are usually in excess of 15 $cm^{-1}$. In addition to satisfying the BMI requirement, it is necessary for the wrapper to contain a finite amount of an alkali-metal burn promoter. The necessary level of burn promoter depends on the BMI of the wrapper. Curve A in FIG. 4 shows the minimum amount of anhydrous potassium citrate per gram of bone-dry paper which is required to enable a cigarette made with that wrapper to free burn continuously in air. However, it is desirable for the wrapper to contain more burn promoter than the minimum level required for free burn in order to obtain normal, or nearly normal, free burn rates and thereby avoid an increase in the puff count. The maximum amount of potassium citrate in the wrapper which will allow a cigarette with that wrapper to self-extinguish in the simulated upholstered furniture test is shown as Curve B in FIG. 4. The range of alkali-metal burn promoter level extends from about 5 mg to about 150 mg of anhydrous potassium citrate per gram of bone-dry base paper, or a stoichiometrically equivalent amount of another alkali-metal salt, for the BMI range of 5.0 $cm^{-1}$ to 1.5 $cm^{-1}$. For the preferred BMI range of 3.5 $cm^{-1}$ to 1.5 $cm^{-1}$, the range of potassium citrate levels extends from about 15 mg to about 150 mg.

The BMI of the inner wrapper for the double-wrap configuration must be within the range of from about 0.1 $cm^{-1}$ to about 4.0 $cm^{-1}$, and preferably in the range of from about 0.1 $cm^{-1}$ to about 2.0 $cm^{-1}$. The outer wrapper preferably has a BMI in the range of from about 6.0 $cm^{-1}$ to about 25 $cm^{-1}$, but the BMI can be as low as about 2.0 $cm^{-1}$ or as high as about 40 $cm^{-1}$. Double-wrapped cigarettes with the inner wrapper in the 0.1 $cm^{-1}$ to 4.0 $cm^{-1}$ range cannot sustain free-burn without the aid of burn promoters. However, in the double-wrap configuration, the inner wrapper need not contain a burn promoter. Preferably, the outer wrapper contains the promoter, potassium citrate or a stoichiometrically equivalent amount of another alkali-metal salt, in excess of the minimum amount required for free burn, but less than the amount which would prevent a cigarette with this wrapper from self-extinguishing in the simulated upholstered furniture test. The range of alkali-metal burn promoter levels, as potassium citrate, extends from about 5 mg to about 150 mg in the outer wrapper when the inner wrapper BMI range of 0.1 to 4.0 $cm^{-1}$. For the preferred, inner wrapper BMI range of 0.1 $cm^{-1}$ to 2.0 $cm^{-1}$, the range of potassium citrate extends from about 15 mg to about 150 mg.

Figure 5:
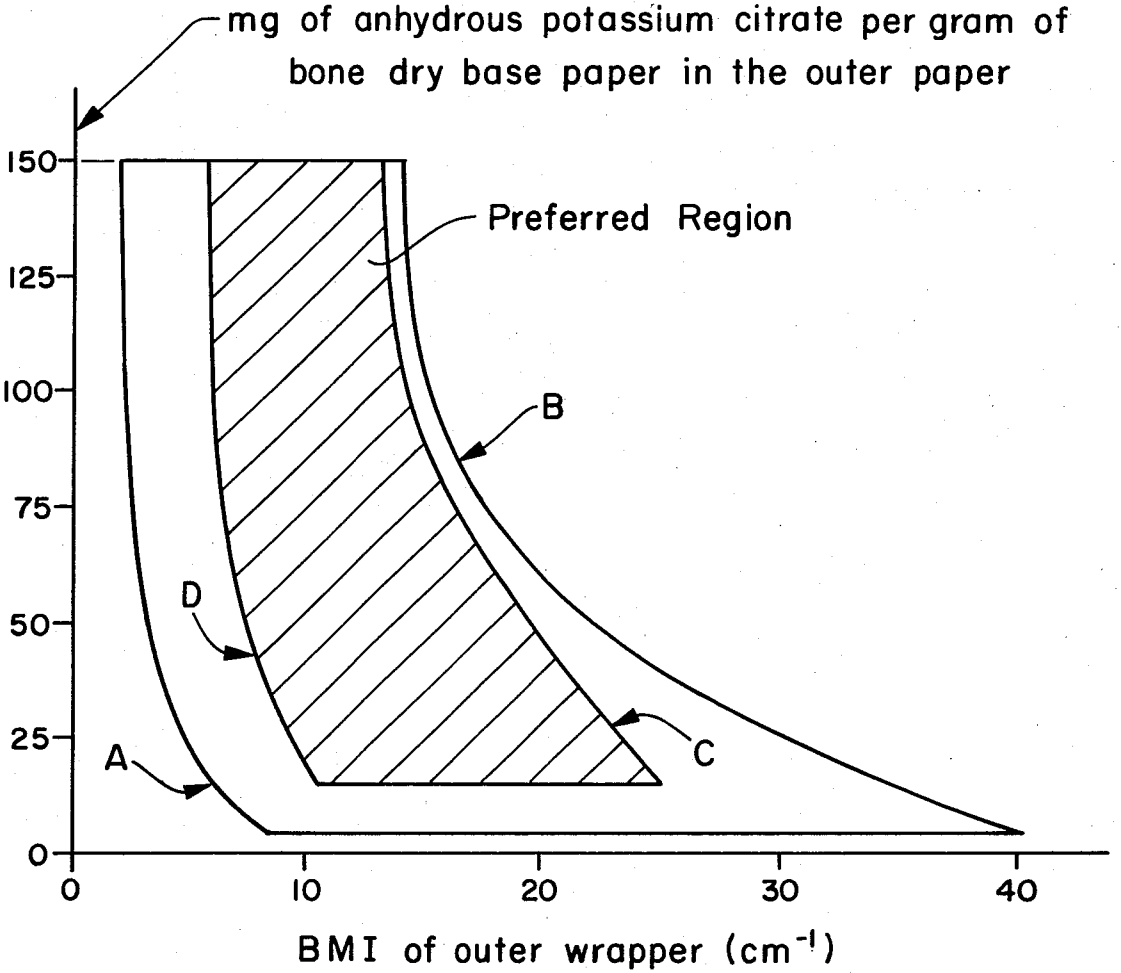
FIG. 5 is a graph, similar to that of FIG. 4, illustrating results obtained with the double-wrap embodiment of the invention.

The range of BMI and potassium citrate levels for the double-wrap configuration is shown in FIG. 5. Curve A shows the minimum amount of potassium citrate in the outer wrapper required for a continuous free burn when the inner wrapper contains no burn promotion additive and its BMI is 4.0 $cm^{-1}$, the upper limit of the allowable BMI range. Curve B shows the amount of potassium citrate in the outer wrapper which will allow cigarettes to self-extinguish in the simulated upholstered furniture test when they are made with that wrapper, and an inner wrapper without burn promotion additives and with a BMI of 0.1 $cm^{-1}$, the lower limit of the allowable BMI range. Therefore, the region enclosed by curves A and B comprises the possible combinations of BMI of the inner and outer wrapper and potassium citrate levels in the outer wrapper, which will result in cigarettes that both free burn continuously in air and self-extinguish in the simulated upholstered furniture test. The preferred region is shaded.

Single-wrapped or double-wrapped cigarettes with wrappers having BMIs and burn promoter levels lying in the previously described ranges exhibit a desirable rate and continuity of free burn in air but self-extinguish quickly and reliably if contacted with a substrate, including many combustible materials such as are used in upholstered furniture. This unique combination of properties demonstrates the highly improved and unexpected results obtained in accordance with the invention. While it is not desired to be limited by any particular theory, it is believed that, although cigarettes wrapped in accordance with the invention burn continuously, reliably, and rapidly in air, they are very sensitive to minor reductions in oxygen supply or coal temperature. This sensitivity provides for the cigarette becoming self-extinguishing when in contact with a substrate, which, at least locally, reduces available oxygen even though that substrate may be made of a combustible material.

Treatment with elevated amounts of the alkali metal burn promoter is an essential feature of the invention when the wrapper has a BMI range less than about 3.5 $cm^{-1}$. In the case of the double-wrap configuration, when the inner wrapper has a BMI of less than 2.0 $cm^{-1}$, the outer wrapper must be treated with elevated amounts of an alkali-metal burn promoter. In general, the ability of the wrapper of the invention to promote vigorous burn of the cigarette in an ash tray, but at the same time cause it to quickly self-extinguish when in contact with a substrate, including many combustible materials, is best achieved when the BMI is in this low range. The alkali-metal salt used can be selected from a wide variety of compositions including the salts of carbonic acid, formic acid, acetic acid, propionic acid, oxalic acid, malonic acid, succinic acid, glutaric acid, malic acid, lactic acid, citric acid, glycolic acid, tartaric acid, and nitric acid. Mixtures of these salts or stoichiometrically equivalent amounts of other carboxylic acid salts of alkali metals can also be used. In the preferred BMI range, potassium salts rather than sodium salts should be used because they more effectively promote free-burn. Levels of potassium citrate above about 150 mg of anhydrous potassium citrate per gram of bone-dry paper are not useful because above this level potassium citrate begins to act as a burn retarder rather than a burn promoter.

Methods of manufacture using double wrappers are known and may include, for example, simultaneously feeding each wrapper from pairs of bobbins or laminating the wrappers and feeding in the manner of a single wrap. In either case the resulting double-wrapped smoking article will have the desired reduced ignition proclivity.

EXAMPLES OF THE INVENTION

Example 1 (Single-wrap configuration)

A cigarette wrapper material was manufactured by employing conventional Fourdrinier papermaking techniques for lightweight papers using Kraft cooked, bleached flax pulp and containing 14% by weight of the anitase form of Titanium Dioxide (Unitane 0-110 from American Cyanamid). The paper was treated so as to contain 90 mg of anhydrous potassium citrate per gram of bone-dry base paper. This paper had the following characteristics: Tappi opacity of 68%, tensile strength of 3800 g/29 mm, permeability of 4 cm/min at 1 centibar, as measured by the CORESTA method, basis weight of 21 $g/m^2$, and BMI of 2.5 $cm^{-1}$.

Cigarettes made with the wrapper at a tobacco column density of 13.2 mg/mm, free burned at 3.8 mm/min, required an atmosphere with 20% oxygen to burn continuously, and self-extinguished in 3 minutes in the simulated upholstered furniture test. Example 1(M) is a repetition with tobacco column density of 9.2 mg/mm.

Example 2 (Single-wrap configuration)

An alternative cigarette wrapper material in accordance with the invention was made as in Example 1 using standard northeastern softwood bleached Kraft pulp with 25% by weight of precipitated calcium carbonate with average particle size of 0.75 micron, consisting of barrel-shaped prisms terminated by rhombohedrons (marketed under the trade name Albaglos, obtained from Pfizer, Inc., Minerals, Pigments and Metals Division). The paper was treated so as to contain 17 mg of anhydrous potassium citrate per gram of bone-dry paper. This paper had the following properties: Tappi opacity of 77%, tensile strength of 5200 g/29 mm, CORESTA permeability of 1.5 cm/min, basis weight of 33 g/m$^2$, and BMI of 3.5 cm$^{-1}$.

Cigarettes made with this wrapper and a tobacco column density of 13.2 mg/mm free-burned at 3.7 mm/min, required an atmosphere with at least 19% oxygen to burn continuously, and self-extinguished in 4 minutes in the simulated upholstered furniture test. Example 2(M) is a repetition with tobacco column density of 9.2 mg/mm.

Example 3 (Single-wrap configuration)

A third embodiment of the cigarette wrapper material of the present invention was made as in Example 1 using Kraft cooked, bleached flax pulp including 12% by weight of the $TiO_2$ described in Example 1 and 2% by weight of the calcium carbonate filler of Example 2. The paper was treated so as to contain 36 mg of anhydrous potassium citrate per gram of bone-dry base paper. This paper had the following characteristics: Tappi opacity of 73%, tensile strength of 4600 g/29 mm, CORESTA permeability of 2 cm/min, a basis weight of 24 g/m$^2$ and BMI of 3.5 cm$^{-1}$.

Cigarettes made with this wrapper and a tobacco column density of 13.2 mg/mm free burned at 3.8 mm/min, required an atmosphere with at least 19% oxygen to burn continuously and self-extinguished in 4 minutes in the simulated upholstered furniture test.

Example 4 (Single-wrap configuraion)

To illustrate the use of alternative base sheets for the wrapper of the present invention, the base sheet of Example 3 was selected for further treatment to lower its BMI. The BMI of the untreated sheet was 3.5 cm$^{-1}$. This sheet was treated by roll coating to achieve an add-on of 1% by weight of Ethylex 2005 (a hydroxyethyl starch obtained from A. E. Staley Manufacturing Company) and potassium citrate at a level of 90 mg of anhydrous potassium citrate per gram of bone dry base paper. The resulting paper had a BMI of 2.5 cm$^{-1}$. Cigarettes made with wrappers of this material had properties similar to those of Example 1.

Thus, conventional wrapper materials having typically high BMI values can be coated or saturated with suitable water soluble, film-forming materials, reducing the BMI to a level useful as base paper in accordance with the present invention. Examples of useful coating or impregnating materials include cellulose ethers such as methyl cellulose and carboxymethyl cellulose; starch or chemically modified starches such as hydroxyethylated or acetylated starch; guar gum, sodium alginate, or other vegetable gums; dextrin; and proteins, such as gelatin or refined vegetable proteins. The application can be made on the paper machine, for example, at the size press, or it can be applied to the formed paper by separate operation such as coating or saturation techniques. Where the composition containing both the sealing material and the alkali metal additive is unstable, separate treatment steps may be used in either order.

Example 5 (Double-wrap configuration)

To illustrate the double-wrapped embodiment of the invention, cigarettes were made using an inner wrapper with a BMI of 1.0 cm$^{-1}$ and no alkali metal salt and an outer wrapper, a commercially available cigarette paper, treated as to contain 60 mg of anhydrous potassium citrate per gram of bone dry base paper. The inner wrapper was manufactured in the same manner as the paper in Example 1. The physical properties of the inner wrapper were: Tappi opacity 68%, tensile strength of 4,000 g/29 mm, CORESTA permeability of 1 cm/min, basis weight of 21 g/m$^2$, and BMI of 1 cm$^{-1}$. The outer wrapper was a commercial cigarette paper containing 30% calcium carbonate (trade name Albacar from Pfizer, Inc.) further treated to contain 60 mg of anhydrous potassium citrate per gram of bone-dry paper. The physical properties of the outer wrapper were: opacity of 74%, tensile strength of 2400 g/29 mm, CORESTA permeability of 55 cm/min, basis weight of 24 g/m$^2$, and BMI of 20 cm$^{-1}$. Cigarettes made with the combination of these two wrappers at a tobacco column density of 13.2 mg/mm free burned at 4.7 mm/min, required an atmosphere with 20% oxygen to burn continuously and self-extinguished in 3 minutes in the simulated upholstered furniture test.

TABLES 1, 2, and 3

In Tables 1, 2, and 3 examples of the invention are identified by numbers and are compared to wrappers identified by letters, with BMI values lying outside the range of the invention, 1.5–5.0 cm$^{-1}$ for single wrapped and 0.1–4.0 cm$^{-1}$ for the inner wrapper of double-wrapped cigarettes.

As Table 1 demonstrates, use of wrappers in accordance with the invention produces desired free-burn rates and reduced ignition proclivity when the BMI is within the defined range. Also illustrated is the surprising effect of treatment with elevated amounts of an alkali-metal burn promoter when the BMI is in the lower range of the invention. In addition, it is shown that no departures from standard cigarette packing density and circumference are required which is contrary to what might have been expected.

Table 2 contains oxygen concentration limit tests and cooling extinction times for Examples 1, 2, and 5 and wrappers A and B. As shown, minor reductions in oxygen are effective in causing the cigarettes of the invention to self-extinguish.

To demonstrate that these beneficial results are obtained while yet managing smoke delivery properties, the cigarettes of Examples 1, 2, and 5 were tested for puff count, dry particulate matter, (DPM), and carbon monoxide. These results, along with the results for conventional unfiltered cigarettes wrappers A and B, are shown in Table 3. Filter ventilation was simulated by reducing the puff volume in a normal F.T.C. smoking regime by the indicated degree of filter ventilation. All cigarettes were smoked for 47 mm. In contrast to earlier attempts, Table 3 demonstrates that the wrappers of the invention do not excessively elevate smoke delivery. This is shown by comparing dry particulate matter, carbon monoxide delivery, free burn rate, and puff count with the results of these tests on conventional cigarettes.

TABLE 1

| | Wrappers with BMI < 1.5 $cm^{-1}$ or BMI > 5.0 $cm^{-1}$ | Permeability (cm/min) | Basis Weight ($g/m^2$) | BMI ($cm^{-1}$) | Alkali Metal Salt Content (mg of anhydrous potassium citrate/g of bone dry base paper) | Tobacco Column Density (mg/mm) Circumference = 25 mm | Free Burn Rate (mm/min) | Ignition Proclivity (min. to ext.) |
|---|---|---|---|---|---|---|---|---|
| | Single-Wrapped Cigarettes | | | | | | | |
| Examples of the Invention (1.5 $cm^{-1}$ ≦ BMI ≦ 5.0 $cm^{-1}$) | | | | | | | | |
| 1 | | 4.0 | 21 | 2.5 | 90 | 13.2 | 3.8 | 3 |
| 2 | | 1.5 | 33 | 3.5 | 17 | 13.2 | 3.7 | 4 |
| 3 | | 2.0 | 24 | 3.5 | 36 | 13.2 | 3.8 | 4 |
| | A | 6.0 | 24 | 7.0 | 8 | 13.2 | 4.0 | inf. |
| | B | 25.0 | 24 | 15.0 | 8 | 13.2 | 4.7 | inf. |
| | C | 10.0 | 24 | 10.0 | 8 | 13.2 | 4.1 | inf. |
| | D | 68.0 | 24 | 20.0 | 8 | 13.2 | 4.9 | inf. |
| | E | 130.0 | 24 | 1.0 | 0 | 13.2 | 0 | — |
| | F | 1.0 | 21 | 1.0 | 90 | 13.2 | 0 | — |
| | A (M) | 6.0 | 24 | 7.0 | 8 | 9.2 | 4.8 | inf. |
| | B (M) | 25.0 | 24 | 15.0 | 8 | 9.2 | 6.2 | inf. |
| 1 (M) | | 4.0 | 21 | 2.5 | 90 | 9.2 | 4.8 | 3 |
| 2 (M) | | 1.5 | 33 | 3.5 | 17 | 9.2 | 4.7 | 4 |
| | Double-Wrapped Cigarettes - (Outer Wrapper/Inner Wrapper) | | | | | | | |
| Examples of the Invention (0.1 $cm^{-1}$ ≦ BMI ≦ 4.0 $cm^{-1}$) | | | | | | | | |
| 5 | | 55/1.0 | 24/21 | 20/1 | 60/0 | 13.2 | 4.7 | 3 |

TABLE 2

| | Wrappers with BMI < 1.5 $cm^{-1}$ or BMI > 5.0 $cm^{-1}$ | Permeability (cm/min) | BMI ($cm^{-1}$) | Alkali Metal Salt Content (mg of anhydrous potassium citrate/g of bone dry base paper | Tobacco Column Density (mg/mm) | Oxygen Conc. Limit (%) | Cooling Extinction (min.) |
|---|---|---|---|---|---|---|---|
| | Single-wrapped Cigarettes | | | | | | |
| Examples of the Invention (1.5 $cm^{-1}$ ≦ BMI ≦ 5.0 $cm^{-1}$) | | | | | | | |
| 1 | | 4.0 | 2.5 | 90 | 13.2 | 20 | 3 |
| 2 | | 1.5 | 3.5 | 17 | 13.2 | 19 | 4 |
| | A | 6.0 | 7.0 | 8 | 13.2 | 18 | 5 |
| | B | 25.0 | 15.0 | 8 | 13.2 | 12 | inf. |
| | Double-Wrapped Cigarettes - Outer Wrapper/Inner Wrapper | | | | | | |
| Examples of the Invention (0.1 $cm^{-1}$ ≦ BMI ≦ 4.0 $cm^{-1}$) | | | | | | | |
| 5 | | 55/1.0 | 20/1.0 | 60/0 | 13.2 | 20 | 3 |

TABLE 3

| | Wrappers with BMI < 1.5 $cm^{-1}$ or BMI > 5.0 $cm^{-1}$ | BMI ($cm^{-1}$) | Permeability (cm/min) | Basis Weight ($g/m^2$) | Alkali Metal Salt Content (mg of anhydrous potassium citrate/g of bone dry base paper) | Tobacco Column Density (mg/mm) Circumference = 25 mm |
|---|---|---|---|---|---|---|
| | Single-Wrapped Cigarettes | | | | | |
| Examples of the Invention (1.5 $cm^{-1}$ ≦ BMI ≦ 5.0 $cm^{-1}$) | | | | | | |
| 1 | | 2.5 | 4.0 | 21 | 90 | 13.2 |
| 2 | | 3.5 | 1.5 | 33 | 17 | 13.2 |
| | A | 7.0 | 6.0 | 24 | 8 | 13.2 |
| | B | 15.0 | 25.0 | 24 | 8 | 13.2 |
| | Double-Wrapped Cigarettes - Outer Wrapper/Inner Wrapper | | | | | |
| Examples of the Invention (0.1 $cm^{-1}$ ≦ BMI ≦ 4.0 $cm^{-1}$) | | | | | | |
| 5 | | 20/1.0 | 55/1.0 | 24/21 | 60/0 | 13.2 |

| | Wrappers with | Free | Filter | Dry Particu- |
|---|---|---|---|---|

TABLE 3-continued

| | BMI < 1.5 $cm^{-1}$ or BMI > 5.0 $cm^{-1}$ | Burn Rate (mm/min) | Ventilation (%) | Puff Count | late Matter (mg/cig.) | Carbon Monoxide (mg/cig.) |
|---|---|---|---|---|---|---|
| | Single-Wrapped Cigarettes | | | | | |
| Examples of the Invention (1.5 $cm^{-1} \leqq$ BMI $\leqq$ 5.0 $cm^{-1}$) | | | | | | |
| 1 | | 3.8 | 30 | 10.0 | 25.3 | 16.9 |
| 2 | | 3.7 | 30 | 10.0 | 25.4 | 18.6 |
| | A | 4.0 | 20 | 9.5 | 23.0 | 14.3 |
| | B | 4.7 | 0 | 8.0 | 25.4 | 16.7 |
| | Double-Wrapped Cigarettes - Outer Wrapper/Inner Wrapper | | | | | |
| Examples of the Invention (0.1 $cm^{-1} \leqq$ BMI $\leqq$ 4.0 $cm^{-1}$) | | | | | | |
| 5 | | 4.7 | 30 | 8.0 | 20.8 | 17.9 |

Figure 2:
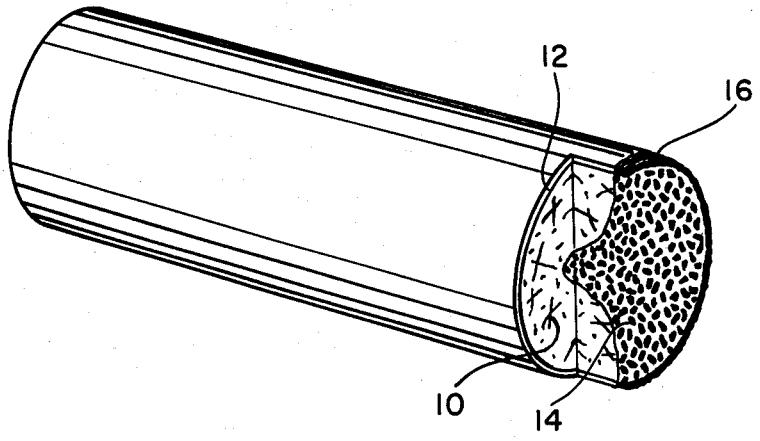
FIG. 2 illustrates in perspective view a single-wrapped cigarette formed in accordance with the present invention partially broken away to illustrate burn characteristics.

Turning to FIG. 2, the single wrap embodiment will be described. As shown, tobacco column 10 is surrounded by wrapper 12. The lit end is shown partially broken away, and includes coal area 14 surrounded by char area 16. While the invention is not to be limited to a particular theory, it is believed that the balance of burn characteristics results from the ability to maintain the coal near the extinction point while allowing just sufficient oxygen availability to continue combustion. Contact with a surface, then, reduces available oxygen from the area of the contact and results in the self-extinction of the cigarette.

Figure 3:
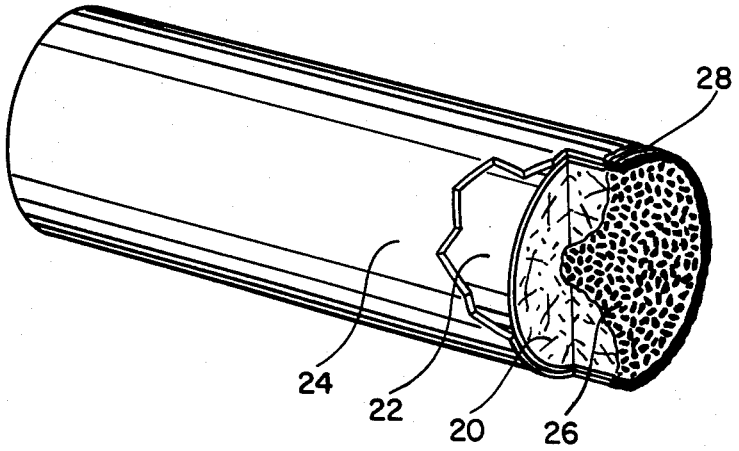
FIG. 3 is a view like that of FIG. 2 except illustrating a double-wrapped configuration.

The same result occurs from the double wrapped structure of FIG. 3. Shown therein is a tobacco column 20 enclosed by an inner wrapper 22 and an outer wrapper 24. The lit end includes the coal area 26 surrounded by the char area 28. The availability of oxygen is again controlled with the result that the desired burn properties are attained.

Curve A in FIG. 4 shows that the alkali metal salt (as potassium citrate) required to obtain burn continuity decreases as BMI value increases for the single-wrapped configuration. Comparison of this graph with the extinction sensitivity test results shown in Table 2 demonstrates the higher reliability of self-extinction of cigarettes with wrappers of low BMI values. Curve B in FIG. 4 shows the approximate maximum level of anhydrous potassium citrate which can be added to a wrapper with a given BMI and still allow cigarettes made with that particular wrapper to self-extinguish in the simulated upholstered furniture test. The region enclosed by curves A and B shows the possible BMI and potassium citrate combinations for cigarette wrappers which will yield cigarettes that will self-extinguish in the simulated upholstered furniture test. The preferred range for the BMI and the potassium citrate levels is shown as a shaded region.

It is difficult for the cigarettes to pass, i.e., self-extinguish, in the simulated upholstered furniture test and only a rather narrow region of combinations of BMI and burn promoter levels will yield wrappers which allow cigarettes to pass this test. Relaxation of the test, for example by a change in the type of upholstery, would shift curve B to the right and therefore widen the region of allowable BMI and level of burn promoter combinations.

FIG. 5 is a graph similar to FIG. 4, but with respect to the double-wrapped configurations. Curve A shows the minimum amounts of potassium citrate required in the outer wrapper for continuous free-burn when the inner wrapper contains no burn promoters and has a BMI of 4.0 $cm^{-1}$. Curve B shows the maximum amount of potassium citrate which the outer wrapper may contain and still allow cigarettes made an inner wrapper with a BMI of 0.1 $cm^{-1}$ to pass the simulated upholstered furniture test. The preferred region is shaded.

Thus, it is apparent that there has been provided in accordance with the invention a wrapping structure for smoking articles and resulting smoking articles that fully satisfy the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A single wrapper construction for smoking articles characterized by continuous free burn and having a reduced tendency to ignite other materials, said construction comprising a cellulose fiber containing base sheet having a BMI in the range of from about 1.5 $cm^{-1}$ to about 5.0 $cm^{-1}$ and said wrapper construction also contains an alkali metal salt burn promoter in an amount equivalent to between about 5 mg. and 150 mg. anhydrous potassium citrate per gram of bone dry base sheet.

2. The wrapper construction of claim 1 wherein said BMI and the amount of alkali metal salt burn promoter as potassium citrate equivalent fall within the shaded area of FIG. 4 as follows:

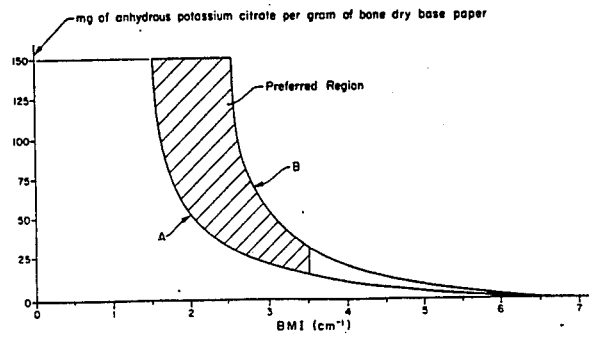

FIG. 4.
Single wrapped cigarettes

3. A double wrapper construction for smoking articles characterized by continuous free burn and having a reduced tendency to ignite other materials, said construction comprising an inner cellulose fiber containing base sheet having a BMI in the range of from about 0.1 $cm^{-1}$ to 4.0 $cm^{-1}$ and an outer cellulose fiber containing base sheet having a BMI in the range of from about 2.0 $cm^{-1}$ to about 40 $cm^{-1}$ and wherein the construction contains an alkali metal salt burn promoter in an amount equivalent to between about 5 mg. and 150 mg. anhydrous potassium citrate per gram of bone dry inner or outer base sheet.

4. The wrapper construction of claims 1 or 3 wherein said cellulose fibers comprise flax.

5. The wrapper construction of claims 1 or 3 wherein said burn promoter is potassium citrate.

6. The wrapper construction of claim 1 wherein the BMI is in the range of from about 1.5 $cm^{-1}$ to 3.5 $cm^{-1}$, and said wrapper construction also contains an alkali metal salt burn promoter in an amount equivalent to between 15 mg. and 150 mg. of anhydrous potassium citrate per gram of bone dry base paper.

7. The wrapper construction of claim 3 wherein the BMI of the inner wrap is in the range of from about 0.1 $cm^{-1}$ to 2.0 $cm^{-1}$ and the burn promoter is contained in the outer base sheet in an amount equivalent to between about 15 mg and 150 mg anhydrous potassium citrate per gram of bone dry base paper.

8. The wrapper construction of claim 2 wherein said BMI of the outer base sheet, said BMI of the inner base sheet and the amount of alkali metal salt burn promoter as potassium citrate equivalent fall within the shaded area of FIG. 5 as follows:

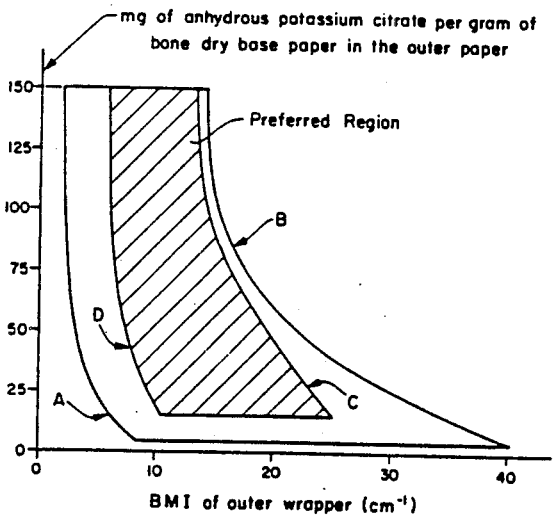

FIG. 5.
Double wrapped cigarettes

9. A smoking article having a reduced tendency to ignite other materials, said article comprising a tobacco column contained within a single wrapper construction comprising a cellulose fiber containing base sheet having a BMI in the range of from about 1.5 $cm^{-1}$ to about 5.0 $cm^{-1}$ and said wrapper construction also contains an alkali metal salt burn promoter in an amount equivalent to between about 5 mg. and 150 mg. anhydrous potassium citrate per gram of bone dry base sheet.

10. The smoking article of claim 9 wherein the BMI is in the range of from about 1.5 $cm^{-1}$ to 3.5 $cm^{-1}$ and said wrapper construction also contains an alkali metal salt burn promoter in an amount equivalent to between 15 mg. and 150 mg. of anhydrous potassium citrate per gram of bone dry base paper.

11. The smoking article of claim 9 wherein said BMI and the amount of alkali metal salt burn promoter as potassium citrate equivalent fall within the area bounded by curves A and B of FIG. 4 as follows:

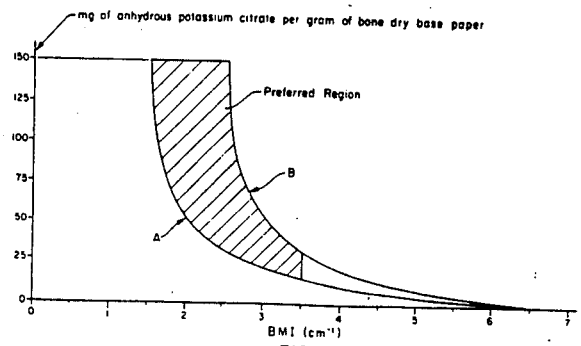

FIG. 4.
Single wrapped cigarettes

12. A smoking article characterized by continuous free burn and having a reduced tendency to ignite other materials, said article comprising a tobacco column contained within a double wrapper construction comprising an inner cellulose fiber containing base sheet having a BMI in the range of from about 0.1 $cm^{-1}$ to 4.0 $cm^{-1}$ and an outer cellulose fiber containing base sheet having a BMI in the range of from about 2.0 $cm^{-1}$ to about 40 $cm^{-1}$ and wherein the construction contains an alkali metal salt burn promoter in an amount equivalent to between about 5 mg. and 150 mg. anhydrous potassium citrate per gram of bone dry inner or outer base sheet.

13. The smoking article of claims 9 or 12 wherein said cellulose fibers comprise flax.

14. The smoking article of claims 9 or 12 wherein said burn promoter is potassium citrate.

15. The smoking article of claim 12 wherein the BMI of the inner wrap is in the range of from about 0.1 $cm^{-1}$ to 2.0 $cm^{-1}$ and the burn promoter is contained in the outer base sheet in an amount equivalent to betwen about 15 mg. and 150 mg. anhydrous potassium citrate per gram of bone dry paper.

16. A smoking article of claim 9 wherein said BMI and the amount of alkali metal salt burn promoter as potassium citrate equivalent fall within the shaded area of FIG. 4 as follows:

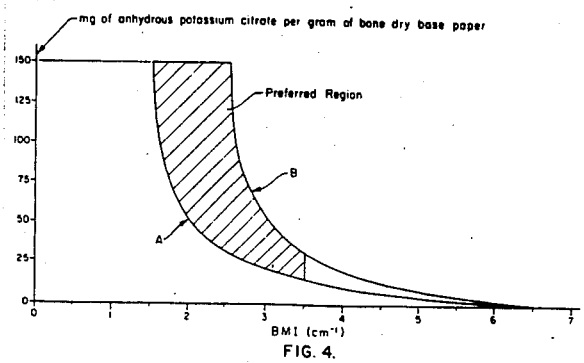

FIG. 4.
Single wrapped cigarettes

17. The smoking article of claim 12 wherein said BMI of the outer base sheet, said BMI of the inner base sheet and the amount of alkali metal salt burn promoter as potassium citrate equivalent fall within the shaded area of FIG. 5 as follows:

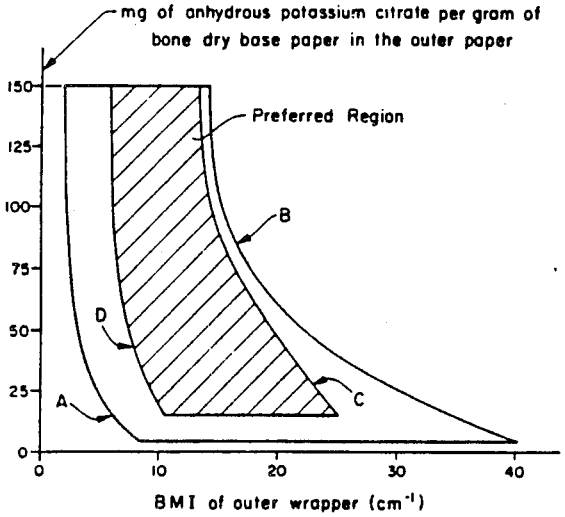

FIG. 5.
Double wrapped cigarettes

18. The smoking article of claim 12 wherein said BMI of the outer base sheet, said BMI of the inner base sheet and amount of alkali metal salt burn promoter as potassium citrate equivalent fall within the area bounded by curves B and D of FIG. 5 as follows:

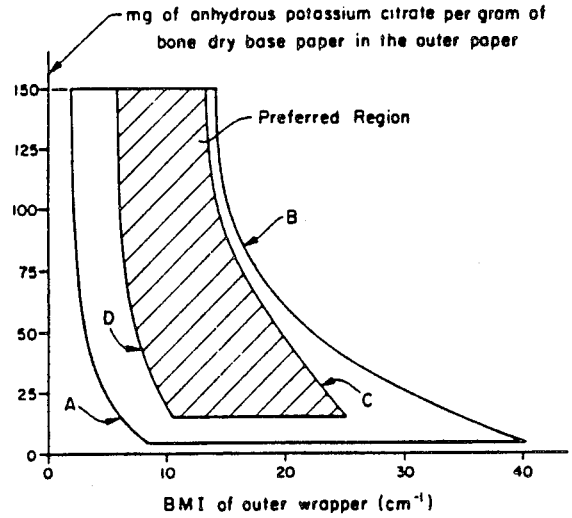

FIG. 5.
Double wrapped cigarettes

* * * * *